United States Patent [19]

Delory et al.

[11] 4,358,707

[45] Nov. 9, 1982

[54] INSULATED COLLECTOR ASSEMBLY FOR POWER ELECTRONIC TUBES AND A TUBE COMPRISING SUCH A COLLECTOR

[75] Inventors: Bernard Delory; Gérard Euloge; Georges Fleury, all of Paris, France

[73] Assignee: Thomson-CSF, Paris, France

[21] Appl. No.: 154,274

[22] Filed: May 29, 1980

[30] Foreign Application Priority Data

May 31, 1979 [FR] France ..... 79 13983

[51] Int. Cl.[3] ..... H01J 23/02

[52] U.S. Cl. ..... 315/5.38; 315/3.5

[58] Field of Search ..... 315/5.38, 3.5, 3.6

[56] References Cited

U.S. PATENT DOCUMENTS

| | | | |
|---|---|---|---|
| 3,823,772 | 7/1974 | Lavering et al. | 315/5.38 |
| 3,824,425 | 7/1974 | Rawls, Jr. | 315/5.38 |
| 4,054,811 | 10/1977 | Huber et al. | 315/5.38 |

FOREIGN PATENT DOCUMENTS

| | | | |
|---|---|---|---|
| 2646498 | 5/1978 | Fed. Rep. of Germany | 315/5.38 |
| 1349152 | 12/1963 | France | 315/5.38 |

*Primary Examiner*—Saxfield Chatmon, Jr.
*Attorney, Agent, or Firm*—Roland Plottel

[57] ABSTRACT

In a power electronic tube the outer surface of the collector is in the shape of a cylinder and has equidistant grooves formed in cross-sections and along the generatrices of this cylinder, which gives them flexibility and allows assembly with an insulating sleeve.

3 Claims, 6 Drawing Figures

INSULATED COLLECTOR ASSEMBLY FOR POWER ELECTRONIC TUBES AND A TUBE COMPRISING SUCH A COLLECTOR

BACKGROUND OF THE INVENTION

The invention relates to an insulated collector assembly and a tube equipped with such a collector. To increase the efficiency of electronic tubes and in particular progressive-wave tubes, the electrons are collected at the end of travel by an electrode, the collector being brought up to a potential between that of the cathode and ground (potential of the anode).

For high-power tubes this electrode dissipates several kilowatts. Its cooling poses delicate problems. In fact, whatever the system of cooling, it is desirable for the cooling fluid only to come into contact with materials at ground potential, especially when the tube is cooled by conduction.

When the power dissipated reaches several kilowatts, it is desirable for the collector to be solid and to have the shape of a cone hollowed out in a metal cylinder so as to distribute heat under the best conditions in the collector. In this case, it is difficult to braze the copper mass to the inside of an insulating cylinder, because of the thermal expansion coefficient differences between the metal and the insulator, which is generally copper and a ceramic.

The invention provides an insulated collector for a power tube which resolves this problem.

SUMMARY OF THE INVENTION

The insulated collector in accordance with the invention is of the type having an insulating sleeve and assembly means between the insulating sleeve and the metal part forming the collecting electrode.

There are elongated flexible metal pieces on the outer surface of the collecting part which are, able to withstand bending and compression stresses.

The invention will be better understood from the following description made with reference to the accompanying drawings.

DESCRIPTION OF THE PREFERRED EMBODIMENTS

Figure 1:
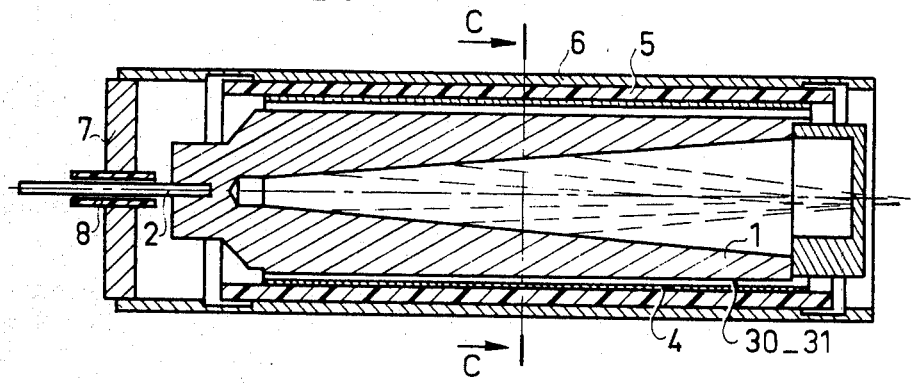
FIG. 1 is a longitudinal sectional view of one embodiment of the collector of the invention.
Figure 3:
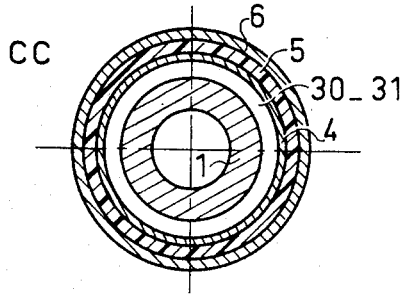
FIG. 3 is a cross sectional view of the embodiment of FIG. 1.

FIGS. 1 and 3 show a collector 1, made from solid copper, receiving the electrons of a beam generated by a unit not shown. These electrons impact on the different parts of the inner surface of the collector which is in the form of a truncated cone of revolution.

This collector may be connected to a fixed potential by a connection 2. The outer surface of the collector supports resilient pieces in the form of fins. These fins are brazed to a thin copper tube 4 coaxial with the tube. This thin cylinder 4 is itself brazed to the inside of a tube 5 made from an insulating material surrounding the unit and ensuring the insulation thereof. The ceramic tube is itself surrounded by a tube 6 for cooling.

This latter cylinder supports an insulating part 7 which supports a connection sleeve 8, through which connection 2 passes.

Figure 2:
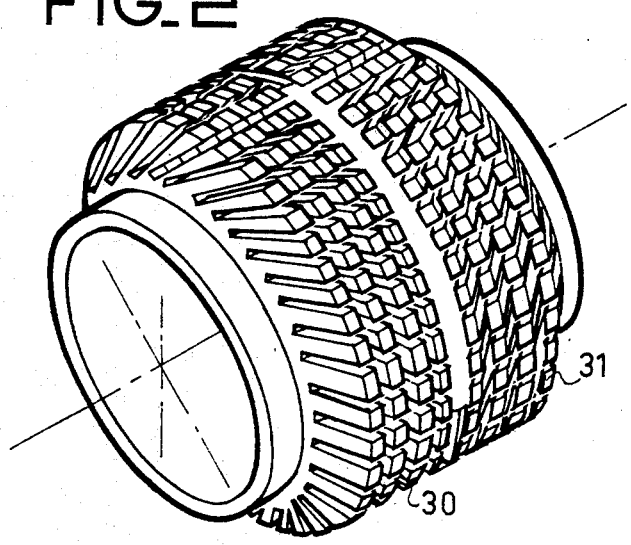
FIG. 2 is a in perspective view of the collector before the ceramic has been fitted.

FIG. 2 shows collector 2 with its fins 30 and 31. These latter result from the formation of grooves along successive cross-sections and along geratrices of the cylinder.

In the case of a collector with a diameter of 40 mm, these grooves are reproduced with a pitch of about 2 mm in both directions. The assembly has the fins sloping through an angle of about 45° with respect to the axis, in one direction for fins 30 and in the other for fins 31. The grooves have a depth for example of 3 mm and a width of 0.5 mm.

Figure 4:
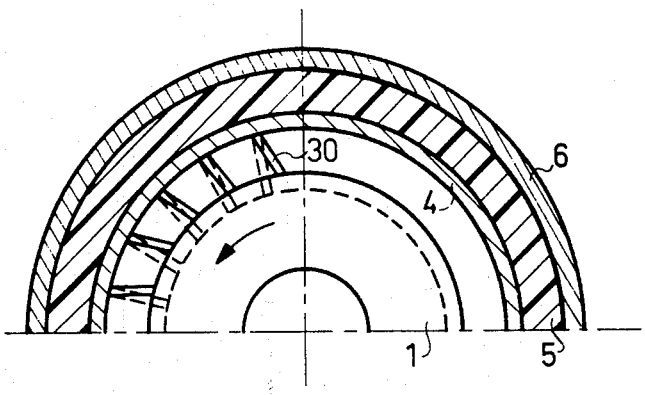
FIGS. 4 and 5 show the effects of expansion on the device of FIG. 1.
Figure 5:
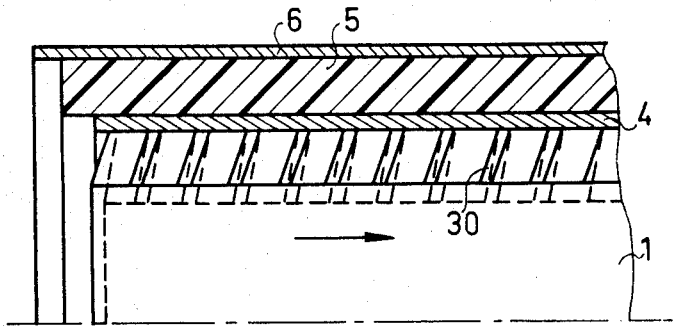

FIGS. 4 and 5 show in longitudinal section and in cross-section how the fins are deformed when the temperature of the collector varies considerably, for example, when it is left to cool down after operation or else at the time of brazing and after cooling.

During cooling, since the expansion coefficient of copper is higher than that of ceramic, it contracts more quickly (see broken line); the fins pivot in the cross-sectional plane as well as in the transverse plane.

Figure 6:
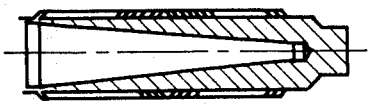
FIG. 6 is a sectional view showing one example of distributing the coupling elements.

FIG. 6 shows, (as does FIG. 2), fins 30 and 31 placed so as to rotate in symmetrical planes, a central cross-section delimiting the frontier between the zone of fins 30 and 31.

Inner copper cylinder 4 could be eliminated, but it has the advantage of distributing the heat more uniformly. Also, the brazing of the grooved collector is more delicate than the brazing of a smooth cylinder.

During cooling, since the assembly does not remain perfectly isothermal the stresses due to the expansion differences are greater at the coldest places; the copper cylinder then distributes the stresses because of its good malleability.

The sub-assembly may for example be formed as follows:

Copper cylinder 1 having the inner form of the collector with its grooves sloping through an angle of about 45° is brazed with hard solder having a higih melting point, for example about 900° C., inside copper cylinder 4. Then the assembly is brazed, with eutectic silver-copper hard solder melting at 780° C., to ceramic 5 previously metallized, at the same time as the outer thin copper cylinder 4.

Usually, the body of the collector is made from copper, for this metal possesses both high thermal conductivity and a fairly high melting point. Nevertheless, for some applications, for tubes operating under pulsed conditions, it may be advantageous to make a collector entirely or partially from a more refractory metal, molybdenum for example. In this case, the expansion coefficient of the collector may be lower than that of the insulator; the same geometry could be kept, except that the angle of slope of the grooves would be at the outset fairly small, just enough for these grooves to slope in the same direction during cooling. In any case, a copper ring will have to be brazed on the refractory metal collector so as to be able to machine the grooves therein.

In the case where a solid cylinder instead of the thin copper cylinder is to be brazed to the outside of the insulating cylinder the same process could be applied; in this case, the grooves would be very slightly sloping at the outset, so that they slope in the same direction during cooling after brazing.

It is evident that this invention also applies to the case where the collector is formed from several insulated electrodes (a collector having two or more stages).

Furthermore, although copper is used in most cases as the malleable material, other metals could possibly be used, such as aluminum.

What is claimed is:

1. An insulated electron collector assembly for high-power electronic tubes of the type comprising an outer insulating sleeve, an inner collector, and a resilient assembly means therebetween, wherein said resilient assembly means consist of a series of flexible metal pieces in the form of teeth distributed on the outer surface of the collector, along rows parallel to the collector axis, said teeth being obliquely directed with regard to the collector axis and to the cross sectional planes perpendicular to said axis and being divided with respect to a cross sectional plane of said collector in two groups, each group having different inclinations.

2. The assembly as claimed in claim 1, wherein a hollow cylinder is brazed to said teeth, this cylinder being fitted in the insulating sleeve.

3. The assembly as claimed in claim 2, wherein the insulating sleeve is fitted in a hollow metal cylinder ensuring radiation of the heat.

* * * * *